US006418583B1

(12) United States Patent
Eyre et al.

(10) Patent No.: US 6,418,583 B1
(45) Date of Patent: Jul. 16, 2002

(54) DECK

(75) Inventors: James Henry Robert Eyre; Ian Peter Thomas Firth, both of London (GB)

(73) Assignees: Flint & Neill Partnership; Wilkinson Eyre Architects Limited, both of London (GB)

( * ) Notice: Subject to any disclaimer, the term of this patent is extended or adjusted under 35 U.S.C. 154(b) by 0 days.

(21) Appl. No.: 09/744,182

(22) PCT Filed: May 19, 2000

(86) PCT No.: PCT/GB00/01923

§ 371 (c)(1),
(2), (4) Date: Jan. 19, 2001

(87) PCT Pub. No.: WO00/71816

PCT Pub. Date: Nov. 30, 2000

(30) Foreign Application Priority Data

May 21, 1999 (GB) ..... 9911940

(51) Int. Cl.[7] ..... E01D 19/12; E04C 2/54
(52) U.S. Cl. ..... 14/73; 52/783.1
(58) Field of Search ..... 14/69.5, 73; 52/783.1, 52/787.1, 796.1

(56) References Cited

U.S. PATENT DOCUMENTS

| | | | | | |
|---|---|---|---|---|---|
| 2,184,137 | A | * | 12/1939 | Brewer | 14/73 |
| 2,907,417 | A | * | 10/1959 | Doerr | 105/422 |
| 3,423,780 | A | * | 1/1969 | Alten | 14/69.5 |
| 4,453,283 | A | * | 6/1984 | Fitzgerald-Smith et al. | 14/2.4 |
| 4,932,178 | A | | 6/1990 | Mozingo | 52/227 |
| 5,454,128 | A | * | 10/1995 | Kwon | 14/73 |
| 5,483,716 | A | * | 1/1996 | Burnaman | 14/73 |
| 5,553,427 | A | * | 9/1996 | Andres | 114/266 |
| 5,642,592 | A | * | 7/1997 | Andres | 114/266 |
| 5,651,154 | A | * | 7/1997 | Ahiskog et al. | 14/6 |
| 5,794,402 | A | | 8/1998 | Dumlao et al. | 52/783.17 |
| 5,836,029 | A | | 11/1998 | Garber et al. | 14/77.1 |
| 5,966,764 | A | * | 10/1999 | Vodicka | 14/74.5 |

FOREIGN PATENT DOCUMENTS

| | | |
|---|---|---|
| BE | 511 972 A | 6/1952 |
| GB | 804 271 A | 11/1958 |

* cited by examiner

*Primary Examiner*—Gary S. Hartmann
(74) *Attorney, Agent, or Firm*—Simpson & Simpson, PLLC

(57) ABSTRACT

A deck comprises a plurality of elongate members (11), such as aluminum extrusions, which each comprise a top flange (12) and a bottom flange (13) interconnected by a web (14) and which are laid side-by-side in abutment and intercoupled, either by integrally shaped parts of the webs or by separate components, such as bars (16), to produce a cellular body with a closed top surface formed by the top flanges (12), a closed bottom surface formed by the bottom flanges (13) and internal bracing. A plurality of tie rods (17) extend transversely of the members (11) by way of bores in the webs (14) and, in conjunction with nuts (18), clamp the members together to form the body into a rigid structure which is stressed in both longitudinal and transverse directions.

18 Claims, 1 Drawing Sheet

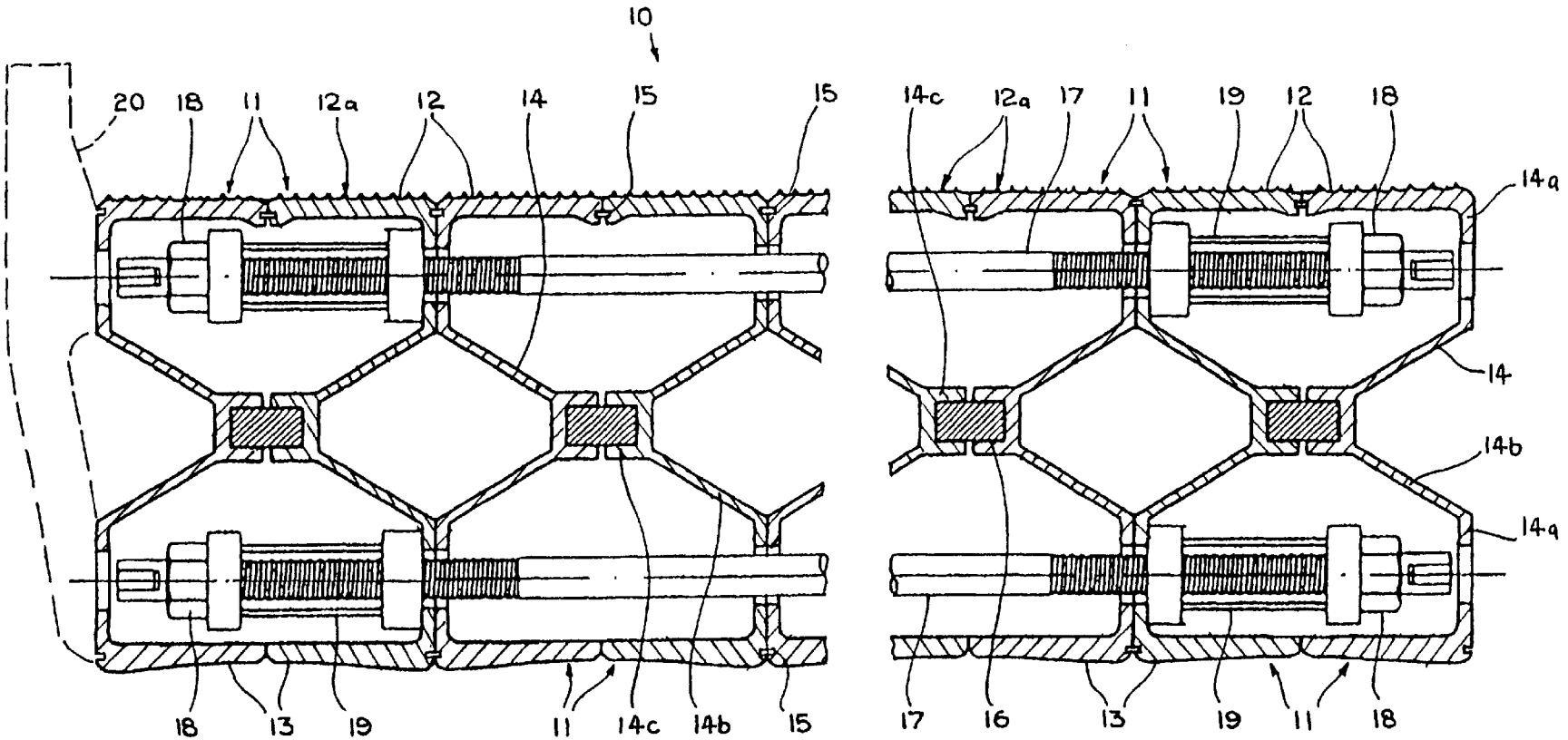
10
11
12
12a
13
14
14a
14b
14c
15
16
17
18
19
20

DECK

BACKGROUND OF THE INVENTION

The present invention relates to a deck, especially a deck suitable for a bridge or the like.

Decks used for bridges and other applications where gaps, voids or unstable beds are to be spanned or covered by a load-bearing structure are commonly supported between their ends from above and/or below at regular intervals by suspension elements, poles or posts imparting a substantial degree of load-bearing capacity to the deck. Alternatively, the decks can be constructed to be self-supporting to a greater extent between their ends or between intermediate supports, which may significantly reduce the cost and complexity of the overall structure or otherwise eliminate problems connected with the siting of supports. Such self-supporting decks must be capable of resisting potentially deforming or even destructive loads both longitudinally, that is to say in the spanning direction, and transversely. The fulfilment of this requirement frequently leads to massive constructions employing profiled girders, decking elements of reinforced concrete or metal aluminum plate and various fittings and fasteners, which together constitute a primary support structure carrying a secondary covering structure. The result is usually a sturdy, but relatively heavy, unit which is expensive in terms of material and time-consuming both to assemble and to finish, such as by weather-proofing or sealing against corrosion. In the longer term, maintenance and reproofing is often necessary.

SUMMARY OF THE INVENTION

It is therefore the principal object of the present invention to provide a deck which has a stiff load-bearing construction without the same degree of penalties in terms of weight, material consumption and assembly time. Subsidiary objects are the provision of a deck which is formed as a finished unit from primary structural elements, i.e. does not require surfacing or cladding by secondary elements, and a reduction in or elimination of the need for finishing and subsequent maintenance. Another such object is the provision of a deck which combines a stressed construction with a capability for pre-assembly formation into curved or other desired shapes. Further objects and advantages of the invention will be apparent from the following description.

According to the present invention there is provided a deck comprising a plurality of elongate members laid side-by-side in mutually abutting relationship in longitudinal direction and intercoupled by intercoupling means to produce a cellular body with a top surface formed by flanges of the members and internal bracing formed by webs of the members, and a plurality of tie elements extending transversely of the members and clamping the members together to form the body into a substantially rigid structure which is stressed in both the longitudinal and the transverse direction of the members Such a deck represents a finished unit usable as, for example, a load-bearing bridge deck supported solely at its ends. The cellular body, which in accordance with constructional principles applicable to internally braced hollow bodies achieves rigidity without the weight and material penalties of solid or heavily reinforced structures, functions as a truss capable of withstanding loads in both the longitudinal and transverse directions of the members, so that in situ the deck is substantially free of tendency to resiliently deflect or even permanently deform under normal loading. The deck can be assembled by the comparatively straightforward procedure of placing the members together in abutment, intercoupling them by interengagement of integral parts or insertion of separately provided intercoupling components and clamping the members together by the transverse tie elements. The resulting assembly can form a closed internally braced structure which has an immediately usable top surface, for example as a pedestrian walkway, and which in relative terms is both strong and light. A covering, which does not have to make a structural contribution, can still be applied to the top surface if desired.

Preferably, the members are substantially identical, whereby production costs may be reduced and assembly procedures simplified. However, it may be expedient in specific applications to include variant forms, for example at the boundaries of the deck, to facilitate access to the tie elements or attachment of subsidiary fittings.

For preference, each of the members is of integral construction in cross-section, preferably an extrusion. An integral as opposed to fabricated construction also assists in keeping down production outlay and usually results in an inherently stronger component free of potential fracture points at weld or fastener locations. Lightness and material saving are also benefits connected with integral construction. The members can be formed by methods, such as folding or rolling, other than extruding. With respect to strength, weight, cost and resistance to corrosion, aluminum is a particularly suitable material for the members.

In one preferred embodiment each of the members comprises one of the flanges forming the top surface, at least one of the webs forming the bracing and a further flange connected to said one flange by the respective web or webs, the further flanges of the members forming a bottom surface of the body. Thus, each member can comprise a top flange, a bottom flange and at least one web interconnecting the flanges, whereby a closed form of the cellular body can be provided by members which are relatively simple and economic to produce and straightforward to arrange as an assembly. In its simplest form, each of the members has a single web connecting the flanges thereof. However, if so desired each member can define a closed, but hollow, body, for example of substantially rectangular or triangular cross-section, which may achieve greater strength at the expense of higher consumption of material. If a single web is employed, its shape can be determined by reference to specific requirements for the bracing and intercoupling functions.

In the case of a member shape with top and bottom flanges it can be of advantage if each of the members is substantially symmetrical with respect to a central transverse plane intermediate those flanges. By virtue of such symmetry, the members can be laterally reversed or even inverted during assembly into the lattice body, so that special attention to the orientation of the individual members is not required or so that, for example, adjacent members can intentionally have different orientations.

The members are preferably intercoupled at points substantially lying in the same plane, particularly a central transverse plane of the body parallel to its top surface. Intercoupling in this manner provides a continuous zone of stressing in shear across the deck and specifically at a location between top and bottom flanges when present. The members can be intercoupled, in particular intercoupled at least in the sense of resisting displacement of the members perpendicularly to the top surface of the body, by way of integrally formed sections capable of interengagement. However, in one preferred embodiment, the intercoupling means are provided by channels defined by the webs and co-operable to form receptacles for bars intercoupling adjacent ones of the members. The co-operating channels can be such as to accommodate varying tolerances in the dimensions and positional relationships of adjacent members and the use of separate bars allows selection of a preferred form or weight of material for, in effect, a joint loaded in shear. Production of the members may also be eased, such as through use of a simpler extrusion die, if the intercoupling function is partly assigned to a separate element The bracing can be formed in various ways, but preferably extends at least in part at an inclination to the top surface of the body. In that case, for example, the webs can be co-operable to define X-shaped bracing zones. The members can, if desired, be oriented oppositely in alternation across the body, which provides additional scope for, inter alias, shaping the webs so that they can combine to define required forms of bracing.

For preference, the members abut one another at abutment surfaces defined by the webs. The webs can be designed with flat portions which define abutment surfaces of such area that a firm, tilt-free contact of adjacent members is provided. Moreover, the members can abut one another at edges of the flanges. It is also of advantage if locating strips are engaged in the flanges of the members to ensure location of flanges of adjacent members in the same plane. The locating strips can slot into, for example, grooves formed in mutually facing surfaces of adjacent flanges.

Various arrangements of the tie elements are possible, but in one preferred embodiment the elements are arranged in two rows one above the other in the body. In that case, each element in the upper row can be arranged above a respective element in the lower row. The elements themselves can be constructed in different ways and can, for example, each have the form of a rod threaded at both ends and nuts threadedly engaged on the ends. Such rods preferably extend through openings in the webs of the members and the nuts are tightened on the rods to clamp the members together at the webs. Tie elements of this form represent a simple and convenient means of binding the members into the stressed structure, with the nuts accessible, for example, through openings in terminating ones of the members at the edges of the deck.

As an additional feature, the flanges forming the top surface of the body can be profiled to provide a tread pattern at that surface. Such a pattern can have the form of, for example, ribs extending longitudinally of the members, an elevated trellis pattern, knubs or any other desired contouring or texturing which assists grip or resists slip.

If so desired, the members can be individually non-rectilinear longitudinally thereof and the body produced by the members can have a non-rectilinear form in at least one of plan and side elevation. Thus, for example, a curved or angularly bent deck can be created by appropriate preshaping of the members, the length and cross-sectional profile of which may permit a certain degree of deformation prior to assembly into the lattice body. The deck can be curved or angularly bent in side elevation, plan or both, which is achievable in prior art decks only with use of, inter alias, appropriately shaped structural and cladding elements, which have to be differently manufactured at the outset for each shape.

In the case of a deck of greater length, each of the members can comprise a plurality of discrete length sections. In that case, the junction or junctions between the length sections of each member are preferably offset relative to that or those of the or each adjacent member. The resulting deck will thus have a staggered arrangement of the length sections in the transverse direction of the deck.

The deck can be used for various purposes, but is particularly suitable as a bridge or part of a bridge. In the latter case the bridge can include upwardly extending lateral guard elements secured at the edges of the deck in the length direction of the members

BRIEF DESCRIPTION OF THE FIGURE

An embodiment of the present invention will now be more particularly described by way of example with reference to the accompanying drawing. The FIGURE is a partial cross-section of a deck embodying the invention.

DETAILED DESCRIPTION

Referring now to the drawings there is shown a deck 10 for a foot bridge intended to be supported at its ends or for a section of a foot bridge intended to be supported at its ends and at one or more intermediate points. The deck may also be used for a vehicle bridge or for other purposes.

The deck 10 comprises a plurality of identically shaped, elongate rail members 11 each of integral construction in cross-section, preferably an aluminum extrusion, and each comprising a top flange 12, a bottom flange 13 substantially parallel to the top flange and a web 14 interconnecting the flanges. The top and bottom flanges are formed with slots in edges thereof adjacent to points of connection with the web and the top flange is additionally formed with a slot in its other edge. The top flange is furthermore provided on its surface remote from the bottom flange with a series of parallel ribs 12*a*.

The web 14 of each member 11 comprises two aligned portions 14*a* respectively connected with the flanges 12 and 13 of that member, two relatively angled portions 14*b* respectively connected with the aligned portions, and a U-shaped portion 14*c* which is connected with the angled portions in a region of convergence thereof and which defines a receiving channel. The limbs of the U-shaped portion 14*a* terminate short of the top and bottom flanges by a predetermined distance providing a desired tolerance. The outer faces of the aligned portions 14*a* thus the faces remote from the U-shaped portion, are coplanar and serve as abutment surfaces in the assembled deck. Each of the aligned portions 14*a* is provided with bores at regular intervals along the length of the member 11. The bores are thus disposed in rows one above the other and each bore in an upper row is arranged above a respective bore in the lower row.

For assembly of the deck, initially an elongate, closed cellular or lattice body is formed by placing the members 11 side by side in abutting relationship in such a manner that each member, apart from those at the longitudinal edges of the body, abuts one adjacent member at the abutment surfaces of the aligned portions 14*a* of the web 14 and abuts the other adjacent member at the free edges of the top and bottom flanges 12 and 13, that is to say the edges remote from the respective web. The members are thus laterally reversed in alternation across the body.

The abutting members 11 are located in vertical direction relative to one another by locating strips 15 engaged in the slots in the edges of the top and bottom flanges and are intercoupled in the same sense by bars 16 engaged in the receiving channels of the U-shaped portions 14*c* of the webs 14. Mutually adjacent portions 14*c* are disposed at a small spacing from one another in the abutting state of the members 11 to compensate for dimensional differences between the members due to tolerances. The cellular body thus produced has closed top and bottom surfaces defined by the abutting top flanges 12 and abutting bottom flanges 13 and an internal X bracing which runs across the body and is provided by the webs 14 supplemented by the bars 16.

The members 11 are now damped together by tie rods 17, which are threaded at both ends and inserted through the bores in the aligned portions 14*a* of the webs 14, and by nuts 18 which are tightened on the threaded ends of the rods and bear against the outermost webs 14, in particular the portions 14*a* thereof, by way of spacers 19. The cellular body is thereby formed into a rigid structure which is stressed both longitudinally and transversely and functions in the manner of a truss to resist bending and shear forces acting on the deck in use thereof as a bridge or bridge section. Notwithstanding the loading-bearing capability of the deck, the basic structure is significantly lighter than structures formed from solid elements such as steel girders and separately applied decking panels and is readily adapted, in manufacture and assembly, to different widths by selection of an appropriate number of members 11 and length of tie rods 17.

The deck can be completed as a bridge by addition of edge posts, handrails and side panels, as schematically indicated by dashed lines 20 in the drawings.

The deck can be constructed with straight members 11 or with members that are curved or bent in plan and/or elevation. If, for example, the deck is to be curved in plan, the individual members can be produced with appropriate individual curvatures and, in assembly, clamped together by tie rods which extend radially or parallelly. Although the rigid structure forming the deck is resistant to bending, the individual members, as aluminum extrusions, can accept and retain a degree of bending and are thus amenable to shaping before assembly into the cellular body.

What is claim is:

1. A deck comprising a plurality of elongate members which each comprises at least one flange and at least one web and which are laid side-by-side in mutually abutting relationship in longitudinal direction of the members, intercoupling means intercoupling the members to produce a cellular body with a top surface formed by said flanges of the members and internal bracing formed by said webs of the members, and a plurality of tie elements extending transversely of the members and clamping the members together to form the body into a substantially rigid structure which is stressed in both the longitudinal direction and the transverse direction of the members, wherein the webs define spaced-apart abutment surfaces at which the members abut one another and wherein the bracing in the region between said abutment surfaces extends at least in part at an inclination to the top surface of the cellular body.

2. A deck according to claim 1, wherein the members are substantially identical with respect to shape and size thereof.

3. A deck according to claim 1, wherein each of the members is of integral construction in cross-section.

4. A deck according to claim 3, wherein each of the members is an extrusion.

5. A deck according to claim 1, wherein each of the members comprises a further flange connected to said one flange by the respective web or webs, said further flanges of the members forming a bottom surface of the cellular body.

6. A deck according to claim 5, wherein each of the members is substantially symmetrical with respect to a central transverse plane intermediate the flanges thereof.

7. A deck according to claim 5, wherein each of the members has a single web connecting the flanges thereof.

8. A deck according to claim 1, wherein the members are intercoupled at points substantially lying in a central transverse plane of the cellular body parallel to the top surface thereof.

9. A deck according to claim 1, wherein the intercoupling means are provided by channels defined by the webs and co-operable to form receptacles for bars intercoupling adjacent one of the members.

10. A deck according to claim 1, wherein the members are laterally reversed in alternation across the cellular body to form in conjunction with the intercoupling means a series of internally braced units each comprising a respective pair of adjacent reversed members.

11. A deck according to claim 1, wherein the members abut one another at edges of the flanges.

12. A deck according to claim 1, comprising locating strips engaged in the flanges of the members to locate flanges of adjacent members in the same plane.

13. A deck according to claim 1, wherein the tie elements are arranged in two rows one above the other in the cellular body.

14. A deck according to claim 13, wherein each tie element in an upper one of the rows is arranged above a respective tie element in a lower one of the rows.

15. A deck according to claim 1, wherein the flanges forming the top surface of the cellular body are profiled to provide a tread pattern at that surface.

16. A deck according to claim 1, wherein the members are individually non-rectilinear longitudinally thereof and the cellular body produced by the members has a non-rectilinear form in at least one of plan view and side elevation thereof.

17. A deck according to claim 1, wherein each of the members comprises a plurality of discrete length sections and the junction or junctions between the length sections of each member are offset relative to that or those of the or each adjacent member.

18. A deck as claimed in claim 1 and provided with upwardly extending lateral guard elements secured at the edges of the deck in the longitudinal direction of the members.

* * * * *